US008485402B2

(12) United States Patent
Smith

(10) Patent No.: US 8,485,402 B2
(45) Date of Patent: Jul. 16, 2013

(54) HANDS FREE ARCHERY BOW SUPPORT

(76) Inventor: Kurt Daniel Smith, Ipswich, MA (US)

( * ) Notice: Subject to any disclaimer, the term of this patent is extended or adjusted under 35 U.S.C. 154(b) by 424 days.

(21) Appl. No.: 12/806,933

(22) Filed: Aug. 23, 2010

(65) Prior Publication Data

US 2012/0043362 A1 Feb. 23, 2012

(51) Int. Cl.
*F41B 5/00* (2006.01)
*F41B 5/18* (2006.01)
*A45F 5/00* (2006.01)

(52) U.S. Cl.
USPC ..... 224/196; 224/916; 224/251; 224/269; 24/648

(58) Field of Classification Search
USPC ... 224/196, 251, 269, 916; 294/115; 248/526; 124/1; 24/598.5, 600.3, 634–635, 645, 648
See application file for complete search history.

(56) References Cited

U.S. PATENT DOCUMENTS 3,952,382 A * 4/1976 Vaage ..... 24/598.5
4,103,807 A 8/1978 Lyon et al.
4,407,260 A * 10/1983 Lyons ..... 124/35.2
4,674,472 A 6/1987 Reis
4,684,047 A 8/1987 Burgwin
4,767,144 A * 8/1988 Hornberg ..... 294/82.36
5,020,508 A * 6/1991 Greene, Jr. ..... 124/35.2
5,038,987 A * 8/1991 Huddleston ..... 224/258
5,239,976 A 8/1993 Specht
D354,393 S * 1/1995 Mocca ..... D29/101.3
5,806,508 A 9/1998 Stempien et al.
5,816,461 A * 10/1998 Balcom ..... 224/269
5,890,478 A 4/1999 Dunmore
6,012,439 A 1/2000 Woodruff
6,948,690 B1 9/2005 Sandel
7,140,585 B2 * 11/2006 Wakuta ..... 248/306
7,302,945 B2 12/2007 Ewing
7,527,182 B1 5/2009 Sherwood et al.
8,336,746 B2 * 12/2012 Leach ..... 224/257
2011/0278333 A1 * 11/2011 Leach ..... 224/257

OTHER PUBLICATIONS www.keystonecountrystore.com/Archery_Equipment_-_Supplies/Wrist_Slings_-_Bow_Carriers/Cherryhill_FastDraw_Bow_Holder/Page_1/BCR3024707.html.

* cited by examiner

*Primary Examiner* — Justin Larson
*Assistant Examiner* — John Cogill
(74) *Attorney, Agent, or Firm* — Lipsitz & McAllister, LLC

(57) ABSTRACT

Apparatus and methods are provided for holding an archery bow in a ready, near shooting position. A harness is worn around a hunter's chest. A sling also attaches to the hunter for holding a lower cam/pulley or lower limb of a compound archery bow. A bow string holder is carried by the harness. The bow string holder attaches to a string portion of the compound archery bow and allows the archery bow to hang therefrom to maintain tension on the bow string holder. The tension prevents the bow string holder from releasing the string until the tension is released upon the hunter's lifting of the archery bow from the sling for shooting an arrow.

8 Claims, 8 Drawing Sheets

HANDS FREE ARCHERY BOW SUPPORT

BACKGROUND OF THE INVENTION

The present invention relates to bow hunting, and more particularly to apparatus and methods for the hands free support of a compound bow or the like on the body of a hunter. The bow is supported in a position that allows it to be easily and quietly lifted for aiming and shooting of an arrow without alerting the game being hunted.

Bow hunters rely on the element of surprise when waiting for game to move naturally through their habitat in close proximity to the hunter's position. Typically, a bow hunter will wait motionless in a strategic, elevated position (e.g., in a treestand), waiting for the game to migrate into range through the hunter's pre-established shooting lanes. Large game (e.g., deer, elk, bear, etc.) travel daily, from bedding areas to feeding areas, and back again. Bow hunters, ideally, enter an animal's habitat quickly and quietly, somewhere along this path, taking great care not to alert game to their presence through scent, sound, or motion. In particular, unnecessary motion is a hunter's undoing when attempting to stay concealed from approaching game. The bow hunter is generally in such close proximity to the animal, that any unnatural motion can alert the animal to the hunter's presence. The game will flee and eliminate any opportunity for the hunter to release an arrow and harvest the animal. Once a hunter is prematurely detected, game will vacate the general area and establish moving patterns in another area undisturbed by human presence.

Hunters typically hang their bows in proximity to them on a hook (screwed into the tree), on a harness/hook on their person, or from a tree limb. In most of these cases, the hunter is in a treestand and usually has his/her back facing the tree. If the bow is attached to anything on the tree the hunter needs to turn, which requires significant body movement and movement of the bow, in order to get into shooting position.

It would be advantageous to provide apparatus and methods that allow a bow hunter to keep his or her compound bow with an arrow nocked in a ready, near shooting position for the eventual passing of game. Such apparatus and methods should allow the hunter to access the bow without having to directly hold it when waiting for game to approach. It would be further advantageous if the hunter does not have to move unnecessarily while reaching for the bow.

It would also be advantageous if once the apparatus is set up to hold the bow in a hands free manner, the hunter can simply move his or her bow hand inches to the natural shooting position on the bow when ready to use the bow. In such a scenario, it would be advantageous if upon lifting of the bow towards the hunter, as the hunter begins to take aim, the bow would automatically be released from the hands free apparatus for use. The hunter could then proceed with aiming and release of an arrow naturally. As the hunter takes aim, it would be still further advantageous if the hands free apparatus would quietly fall away from the bow and return to a position adjacent the hunter's body for future use.

The present invention provides apparatus and methods having the aforementioned and other advantages.

SUMMARY OF THE INVENTION

In accordance with the invention, apparatus is provided for holding an archery bow in a ready, near shooting position. A bow string holder has a releasable string hook. A spring loaded actuator is provided for the string hook. The actuator allows the string hook to move from an open position to a closed position and vice-versa. The string hook remains in the closed position when tension is applied thereto by a bow string captured therein. The string hook automatically opens to release the bow string upon removal of the tension.

In an illustrated embodiment, the bow string holder comprises a tunnel intersected by a tunnel cam pin. The string hook has a scissor mechanism adapted to slide within the tunnel such that the string hook will be in the open position when a scissor arm is actuated by the tunnel cam pin and in the closed position when the arm is not actuated by the tunnel cam pin. The string hook is spring loaded into the open position.

More specifically, the bow string holder can comprise a tunnel extending from a tunnel stop, the tunnel having a pair of oppositely disposed slots along a length thereof. A tunnel pusher extends from a tunnel pusher stop. The tunnel pusher stop is spring loaded away from the tunnel stop. A scissor mechanism is coupled to the tunnel pusher. The scissor mechanism has actuating levers at an end thereof closest to the tunnel pusher stop. The actuating levers form the string hook at an opposite end thereof. The tunnel pusher and scissor mechanism are adapted to slide within the tunnel such that the string hook will be in the open position when the actuating levers are registered with the slots and in the closed position when not registered with the slots. The tunnel pusher stop is movable toward the tunnel stop against the force of the spring loading to slide the actuating levers out of registration with the slots and thereby close the string hook. The tunnel can comprise a channel at its distal end from the tunnel stop for allowing the string hook to capture and close around the bow string when the bow string is positioned within the channel.

The apparatus can further comprise a user harness. In such an embodiment, means are provided for attaching the user harness to the bow string holder. A sling is also provided for use in conjunction with the bow string holder and harness. The sling is adapted to attach to a user (i.e. bow hunter) for holding a lower cam/pulley of a compound archery bow.

The present invention also provides apparatus for holding an archery bow in a ready, near shooting position, where a user harness is adapted to be worn around a hunter's chest. A sling is adapted to attach to the hunter for holding a lower cam/pulley of a compound archery bow. A bow string holder is carried by the harness. The bow string holder is adapted to attach to a string portion of the compound archery bow allowing the archery bow to hang from the bow string holder to maintain tension on the bow string holder. The tension prevents the bow string holder from releasing the string until the tension is released upon the hunter's lifting of the archery bow from the sling for shooting an arrow.

The bow string holder can comprise, for example, a releasable string hook. In such an embodiment, a spring loaded actuator for the string hook is provided. The actuator allows the string hook to move from an open position to a closed position and vice-versa. The string hook remains in the closed position when tension is applied thereto by a bow string captured therein. The string hook automatically opens to release the bow string upon removal of the tension.

The bow string holder can further comprise a tunnel extending from a tunnel stop. The tunnel can have a pair of oppositely disposed slots along a length thereof. A tunnel pusher can extend from a tunnel pusher stop. The tunnel pusher is slidably received within the tunnel with the tunnel pusher stop being spring loaded away from the tunnel stop. A scissor mechanism is coupled to the tunnel pusher. The scissor mechanism has actuating levers at an end thereof closest to the tunnel pusher stop and forms the string hook at an opposite end thereof. The scissor mechanism is adapted to slide within the tunnel together with the tunnel pusher such that the string hook will be in the open position when the actuating levers are registered with the slots and in the closed position when not registered with the slots. The tunnel pusher stop is movable toward the tunnel stop against the force of the spring loading to slide the actuating levers out of registration with the slots and thereby close the string hook.

The tunnel can comprise a channel at its distal end from said tunnel stop. The purpose of the channel is to allow the string hook to capture and close around the bow string when the bow string is positioned within the channel.

A method is provided for temporarily holding an archery bow in a ready, near shooting position. In accordance with the method, a lower portion of the archery bow is supported in a sling attached to a hunter's body. A bow string holder is supported from the hunter's body. A string hook portion of the bow string holder is attached to a string of the archery bow. The archery bow is allowed to hang from the bow string holder to maintain tension on the string hook. This tension prevents the string hook from releasing the string. The archery bow is subsequently lifted from the sling when the hunter is ready to aim and shoot an arrow, thereby releasing the tension and releasing the string hook from the archery bow string.

In accordance with the aforementioned method, the string hook can be spring loaded in the bow string holder to maintain the string hook in an open position absent the tension. The step of attaching the string hook to the string can comprise manually pushing the string hook against the spring loading to close the string hook around the string.

An arrow can be nocked (i.e., positioned) on the string of the archery bow prior to the step of attaching the string hook to the string. The string hook can be attached to the string either directly or via a string loop. The bow string holder can alternatively comprise a hook that simply falls away from the string due to gravity or other means (such as a mechanical spring force, for example) when tension between the hook and the string is released.

DETAILED DESCRIPTION OF THE INVENTION

Figure 1:
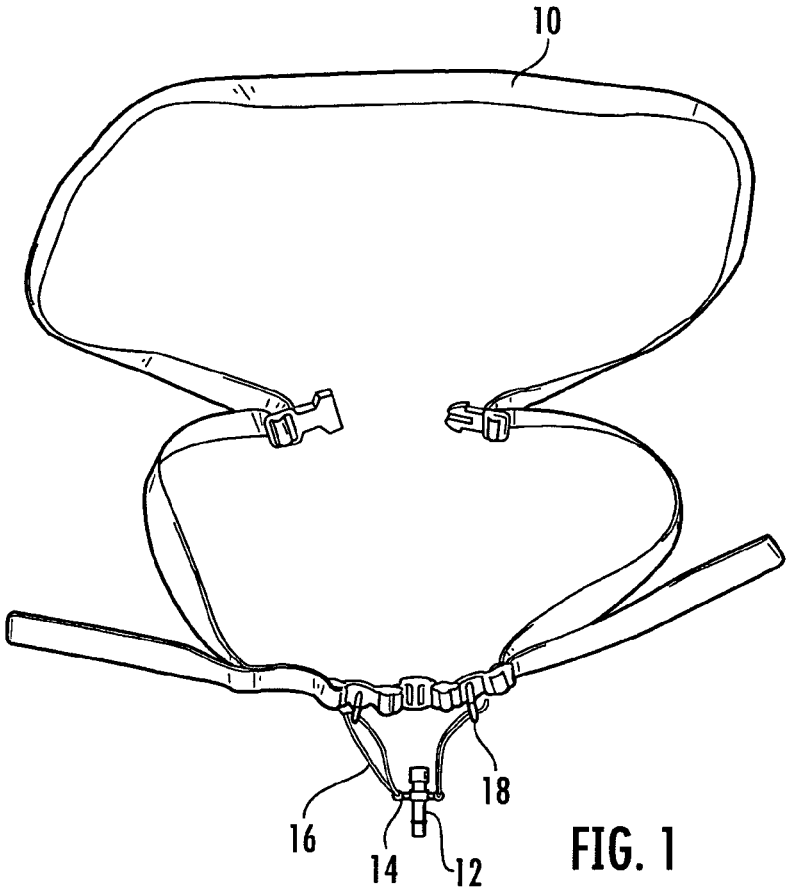
FIG. 1 is an illustration of a harness for a bow string holder with the bow string holder attached thereto.
Figure 2:
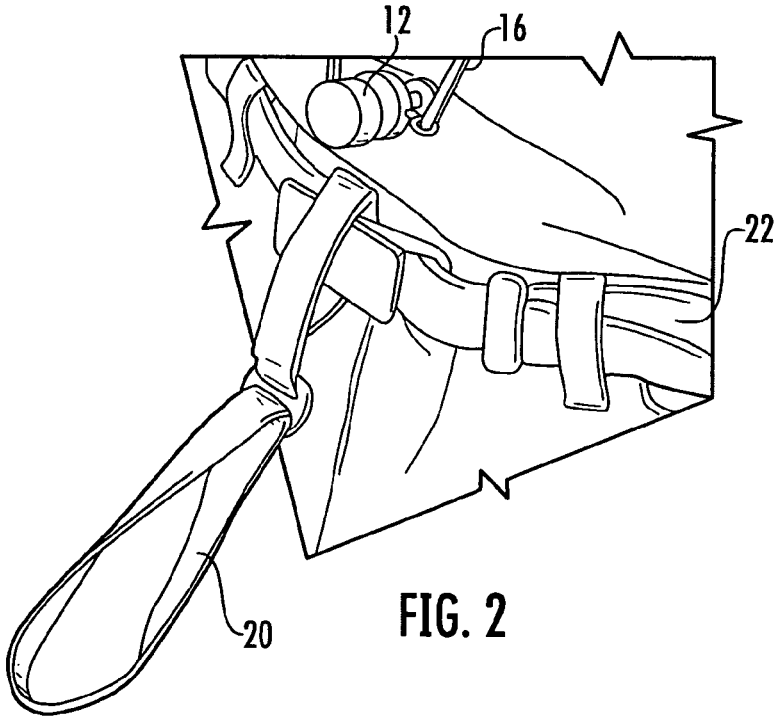
FIG. 2 is an illustration of a sling for supporting the lower portion of an archery bow.

FIGS. 1 and 2 illustrate the key components of a preferred embodiment of the present invention. As shown in FIG. 1, a harness 10 is adapted to be worn on a hunter's chest for the purpose of supporting a bow string holder 12. The bow string holder can, for example, be directly carried by the harness or can hang from the harness as shown in the Figures. In the illustrated embodiment, the bow string holder is attached to loops or rings 18 of harness 10 via eye hooks 14 and cords 16. The eye hooks can be threaded into the body of bow string holder 12 and secured with locknuts 15. The cords 16 are tied between the eye hooks 14 and rings 18. These components can be seen in greater detail in FIGS. 3 and 4.

Figure 12:
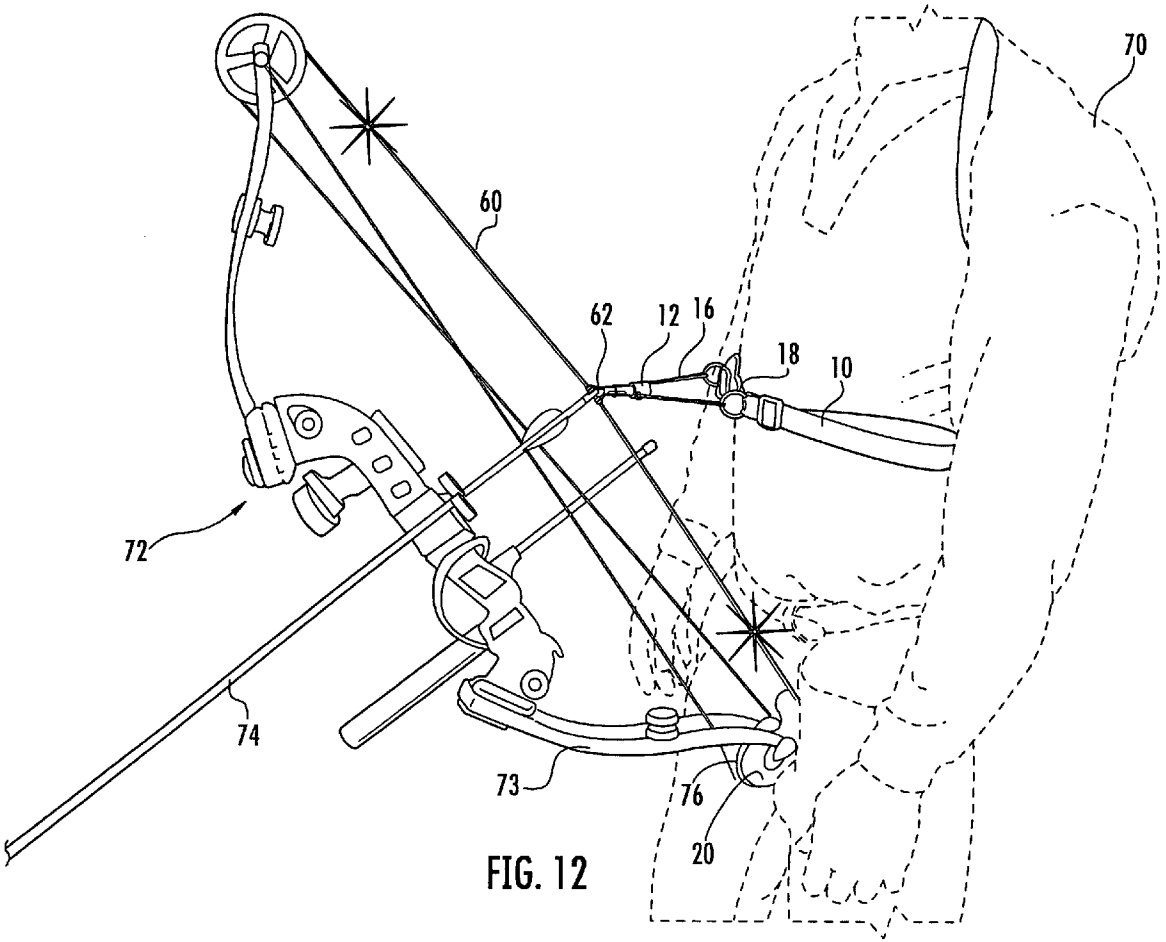
FIG. 12 is an illustration of the harness and sling being worn by a hunter, with the bow string holder in its closed position holding the string loop of a compound bow which is supported in the sling.

In addition to the harness 10, the hunter also carries a sling 20 as illustrated in FIG. 2. The sling can be attached, for example, to the hunter's belt 22. The purpose of the sling is to releasably support a compound archery bow, e.g., by holding a lower cam/pulley 76 or lower limb 73 of the bow 72 as illustrated in FIG. 12. It should be appreciated that many other types of supports for the bow could be substituted for the sling, such as a hook or rigid support that extends from the hunter's body. Alternatively, a support for the bow, such as a shelf or the like, could be provided on a tree stand in which the hunter stands or sits.

Figure 3:
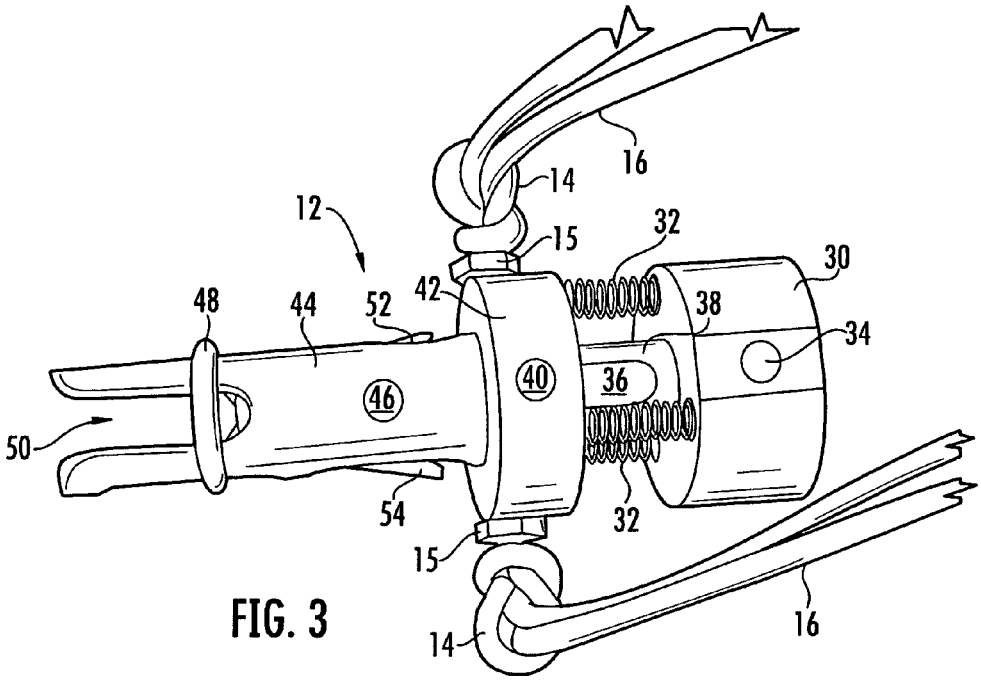
FIG. 3 is an illustration of the bow string holder in its open position.

FIG. 3 shows the bow string holder 12 in greater detail. The bow string holder can be fabricated from any suitable material such as metal, plastic, or a combination of both. In a preferred embodiment, the bow string holder is made from metal (e.g., stainless steel and/or aluminium). The purpose of the bow string holder is to hold the compound archery bow 72 by its string 60 (FIG. 12) when the bow is not being held by the hunter (i.e., when the bow is supported in a "hands free" resting mode). In a preferred embodiment, the string 60 is held via a string loop 62, best seen in FIG. 13. A further purpose of the bow string holder 12 is to automatically release the string 60, and therefore the bow 72, when the hunter lifts the bow into an aiming position. While the bow string holder can comprise a simple hook that falls off of the string loop 62 due to gravity or by other means (e.g., mechanical means) when the bow is lifted by the hunter, a preferred embodiment comprises a spring loaded device as illustrated in the Figures.

Figure 5:
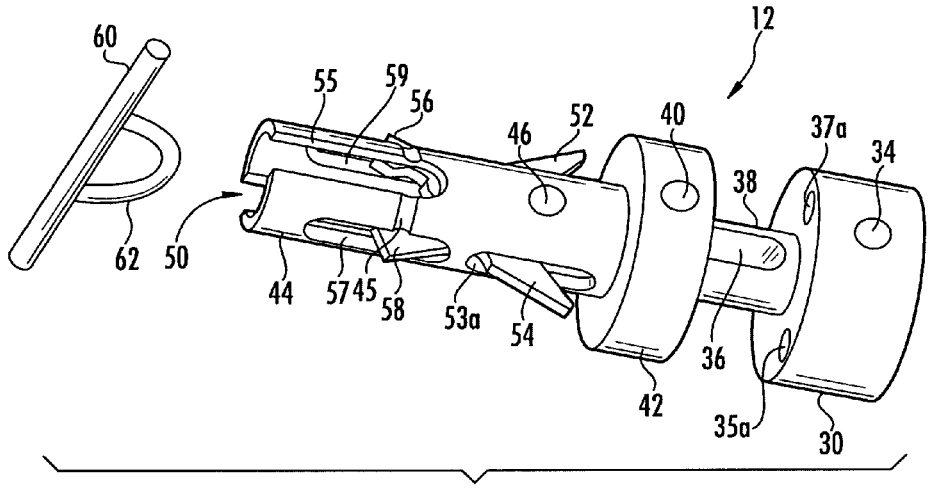
FIG. 5 is a schematic perspective illustration of the bow string holder in its open position, aligned with a bow string and string loop to which the bow string holder can be attached.
Figure 6:
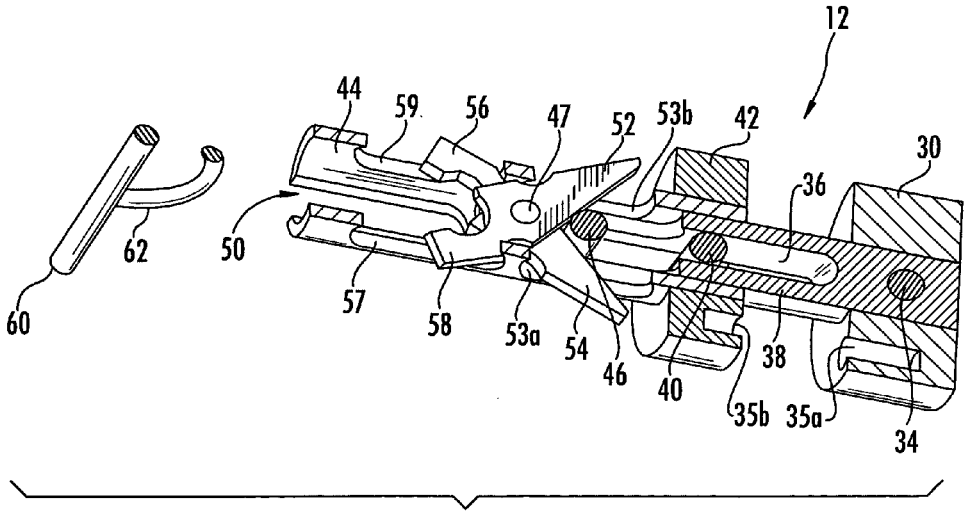
FIG. 6 is a schematic perspective cross-sectional illustration of the bow string holder in its open position, aligned with a bow string and string loop to which the bow string holder can be attached.
Figure 7:
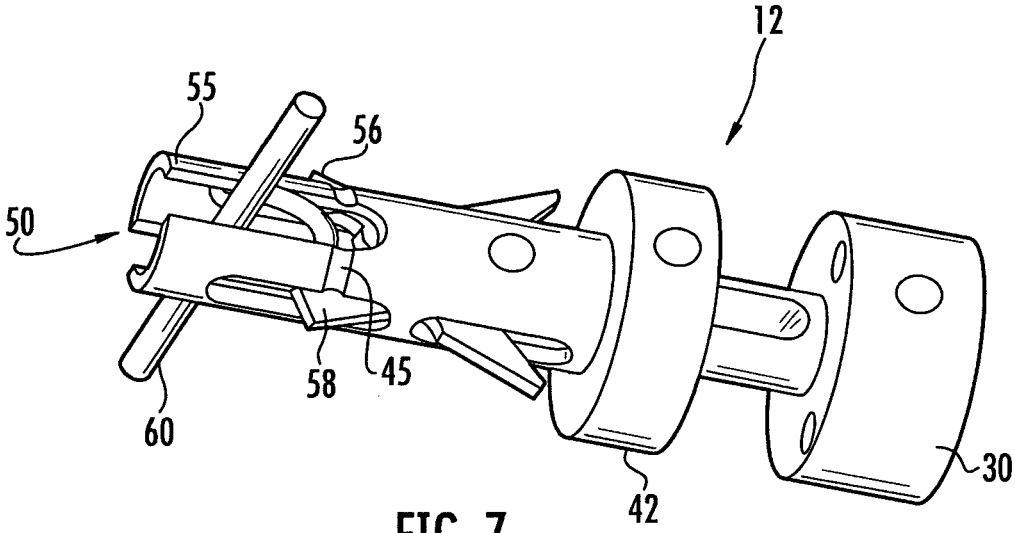
FIG. 7 is a schematic perspective illustration of the bow string holder in its open position, partially engaged with the string loop.
Figure 8:
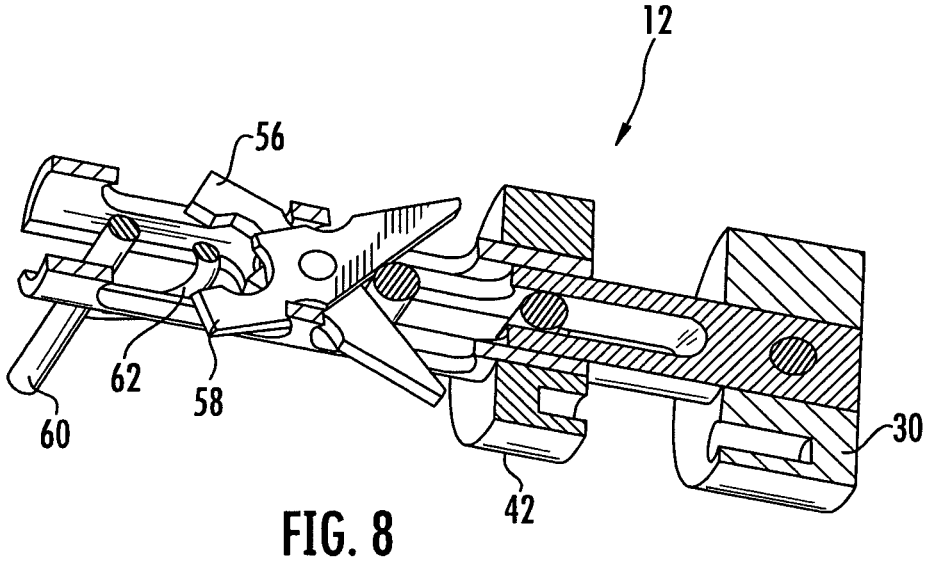
FIG. 8 is a schematic perspective cross-sectional illustration of the bow string holder in its open position, partially engaged with the string loop.

As shown in FIG. 3, such a spring loaded bow string holder 12 can comprise a tunnel pusher stop 30 that carries a tunnel pusher 38. The tunnel pusher stop 30 serves as an actuator for a string hook formed by a right hooked link 56 and a left hooked link 58 (FIG. 6). The tunnel pusher stop 30 is biased away from a tunnel stop 42 by springs 32. The springs reside in a plurality of blind holes (channels) machined in the tunnel pusher stop 30 and tunnel stop 42 such as holes 35*a* and 35*b* as well as 37*a* illustrated, for example, in FIGS. 5-6. In the illustrated embodiment, a total of three springs are used and placed equidistantly around the circumference of the tunnel pusher stop 30 and tunnel stop 42.

The tunnel pusher 38 can be held to the tunnel pusher stop 30 via a dowel or pin 34. A slot 36 of the tunnel pusher rides on dowel or pin 40 within a tunnel 50 provided by the cylindrical inside diameter of tube 44. The tube 44 and hence the tunnel 50 extends from the tunnel stop 42. The dowel or pin 40 can also be used to attach the tube 44 to the tunnel stop 42. A tunnel cam pin 46 is provided to cam the actuating arms 52, 54 of a scissor mechanism that opens and closes the string hook. The scissor mechanism pivots around a pivot 47. Slots 53*a*, 53*b* in the tube 44 allow the actuating arms 54, 52 of the scissor mechanism to extend beyond the tunnel when the string hook links 56, 58 are in the open position. Similarly, slots 57, 59 in the tube 44 allow the left hooked link 58 and the right hooked link 56, respectively, to extend beyond the tunnel when in the open position. In the preferred embodiment, an O-ring 48, preferably made of rubber, is provided to dampen any noise generated when the string hook opens to release the string of an archery bow. The O-ring is retained in position by an external groove 45 on the tube 44. The groove is located to contact the opening links 56, 58 at the proper moment to dampen the sound that would otherwise be emitted. As will be appreciated by those skilled in the art, other means can be utilized instead of the O-ring for silencing the mechanism during operation.

The string hook can be attached either directly to a bow string 60, or to the bow string 60 via a string loop 62. A slot 55 is provided in the tunnel 50, at the distal end of the tube 44, in order to allow the string 60 or string loop 62 to be captured by the string hook formed by the left hooked link 58 and the right hooked link 56.

Figure 4:
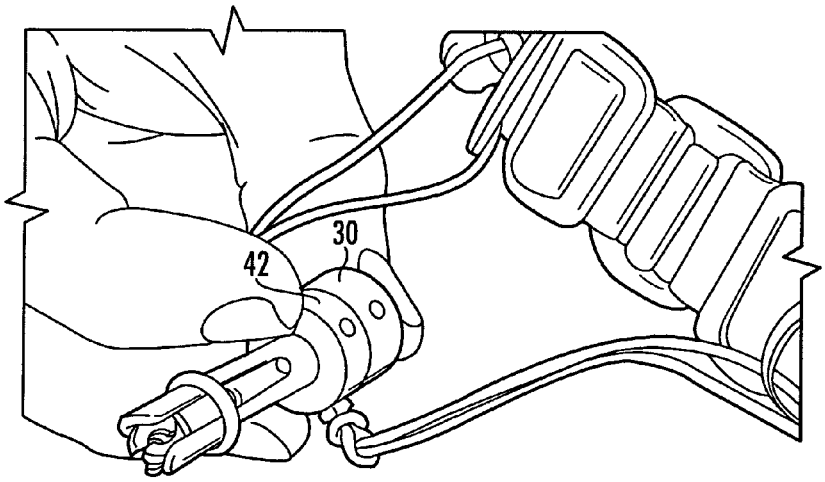
FIG. 4 is an illustration of the bow string holder being actuated and held in its closed position.
Figure 9:
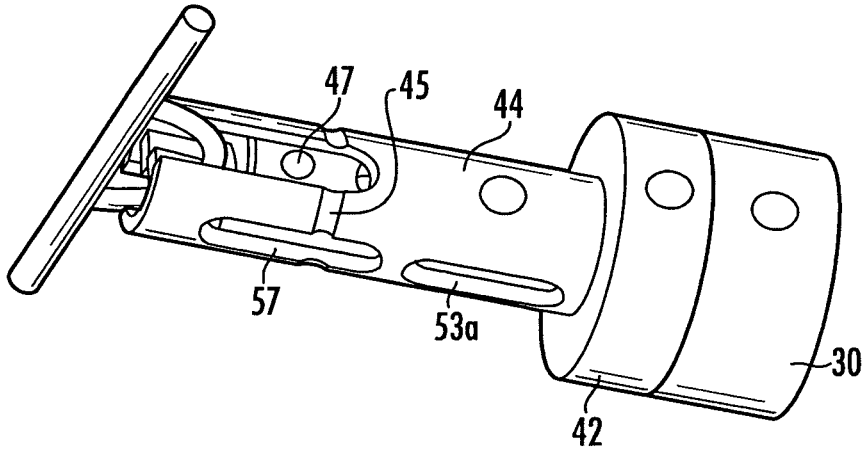
FIG. 9 is a schematic perspective illustration of the bow string holder in its closed position, fully engaged with the string loop.
Figure 10:
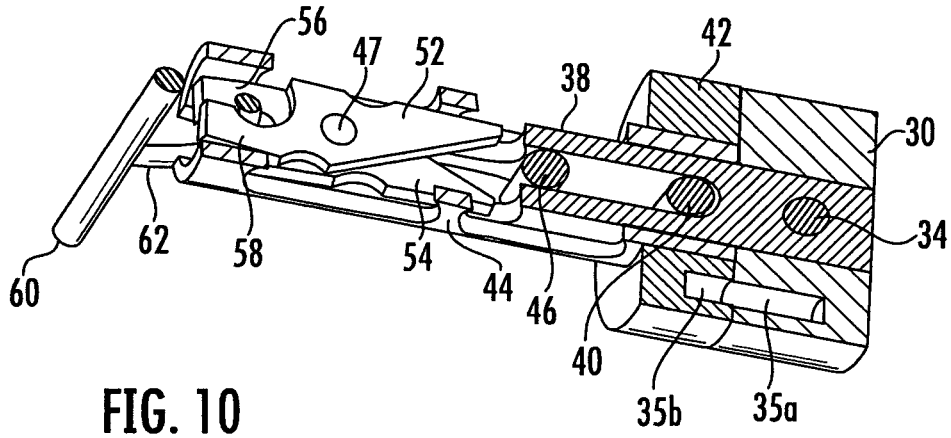
FIG. 10 is a schematic perspective cross-sectional illustration of the bow string holder in its closed position, fully engaged with the string loop.

As can be seen in FIG. 4, the string hook will close upon actuation of the bow string holder 12 by a user. More specifically, by pushing the tunnel pusher stop 30 toward the tunnel stop 42 against the force of the springs 32, the scissor action of the scissor mechanism will cause the left hooked link 58 and the right hooked link 56 to close. In the illustrated embodiment, the scissors mechanism is closed by the cam action of the inside/front edges of slots 53*a* and 53*b* against the outside surfaces of arms 52, 54. Thus, once the bow string 60 or string loop 62 is within the grasp of the string hook, the hunter can close the hook onto the string or string loop by pressing on the tunnel pusher stop. This procedure is illustrated in greater detail in FIGS. 5-10, which show a sequence in which:

(A) the string hook starts off fully open inside the tunnel 50, with the bow string 60 and string loop 62 to the left of the bow string hook 12 (FIGS. 5-6), (B) the string hook is still open, but the string 60 and string loop 62 are captured within the slot 55 of the tunnel 50 and positioned for capture by the string hook links 56, 58 (FIGS. 7-8), and (C) the string hook has captured the string loop 62 by having the hunter manually press tunnel pusher stop 30 against tunnel stop 42, which causes the left hooked link 58 and the right hooked link 56 to close due to the scissor action around pivot 47 (FIGS. 9-10).

Figure 11:
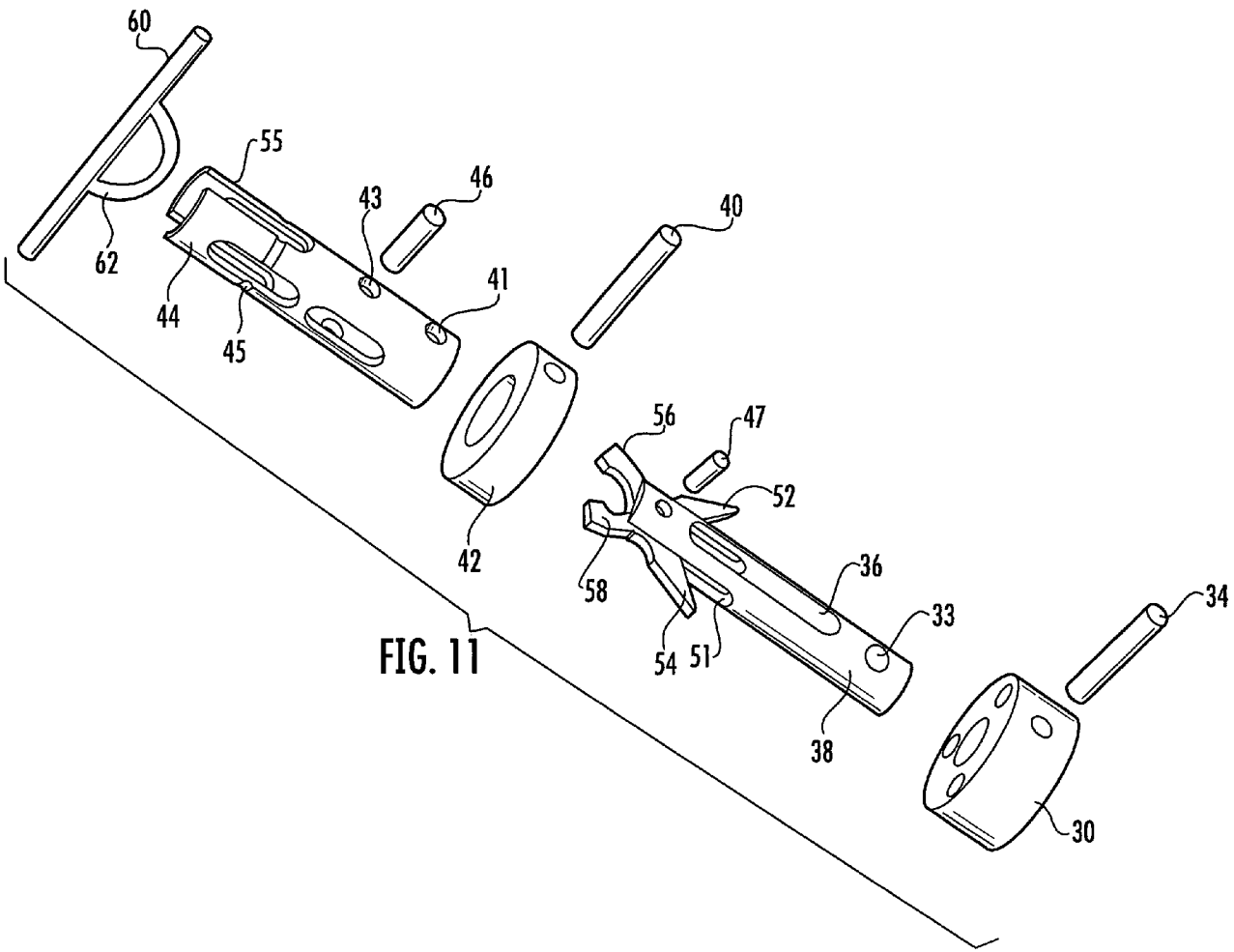
FIG. 11 is an exploded view of the bow string holder showing the various components thereof in proximity to a bow string and string loop.

FIG. 11 is an exploded view of the bow string holder 12, showing how the various components thereof are assembled. In addition to the components already discussed that can be seen in the other Figures, FIG. 11 shows the shaft 33 through which dowel or pin 34 is positioned to secure tunnel pusher stop 30 to the tunnel pusher 38. Also shown is the shaft 41 through which dowel or pin 40 is positioned to secure the tunnel stop 42 to the tube 44. A slot 51 is shown that accommodates the scissor mechanism formed by arms 52, 54 and string hook links 56, 58. Pin 46 is inserted into the assembly after the scissor mechanism has been pushed into tube 44 past the position of hole 43 (see also FIGS. 6, 8 and 10 for various positions of the scissor mechanism relative to pin 46 in the finished assembly).

Figure 13:
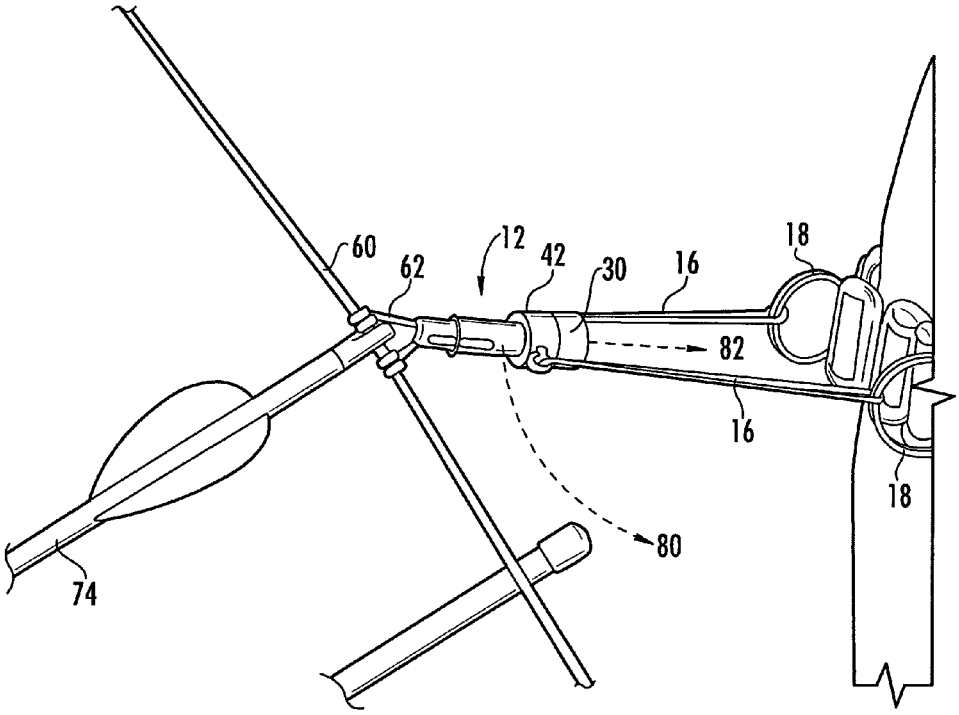
FIG. 13 is a close up view of the bow string holder, string loop and portions of the compound bow and harness of FIG. 12.

In use, once the string hook has captured the string (e.g., via string loop 62) as shown in FIG. 10, the string hook will remain closed and locked in position by the walls of tunnel 50 as long as enough tension is kept on the closed ends of the left hooked link 58 and the right hooked link 56 to overcome the force of the springs 32 (FIG. 3). Thus, the bow string 60 (via string loop 62) will not be released. This tension will be maintained by the weight of the archery bow 72 pulling on the string holder 12 in the direction opposite dashed line 82 as shown in FIGS. 12 and 13. Referring to FIG. 13, as soon as the hunter lifts the bow 72 up to take aim, the tension from the bow on the bow string holder 12 in the direction opposite dashed line 82 will be released, the string hook will open due to the force of springs 32 pushing tunnel pusher stop 30 in the direction of dashed line 82 (i.e. away from tunnel stop 42), the string loop 62 will be released, and the bow string holder 12 will quietly fall away in the direction of the curved arrow 80 due to the pull of gravity or some other (e.g., mechanical) means. At the same time, the lower cam/pulley 76 and/or lower limb 73 of the compound bow will have released from the sling 20. The hunter can then finish aiming and release the arrow 74 toward the game.

During the procedure described above, string hook links 56, 58 open due to the action of springs 32 forcing the inside surfaces of arms 52, 54 against the cam pin 46. After the arms (levers) make contact with the cam pin, they continue to ride down the pin, which opens the string hook by scissors action.

In the specific illustrated implementation disclosed above, which is intended to be illustrative only and in no way limiting, the apparatus of the invention comprises various components that are all secured to the hunter as an assembly centered at chest height. The assembly is secured by the harness 10 in such a way as to hang freely in front of the hunter (preferably no lower that the hunter's navel) when not in use. This allows the bow string holder 12 to be lifted to a slightly below horizontal position for use in front of the hunter. The bow string holder 12 is made up of two sub-assemblies: the tunnel sub-assembly and the tunnel pusher sub-assembly. The tunnel sub-assembly is comprised of three parts: the tunnel 50, the tunnel cam pin 46 and the tunnel stop 42. This sub-assembly is affixed to the harness 10 the hunter wears. The tunnel 50 and tunnel stop 42 are securely pinned together via a press fit dowel 40. The tunnel cam pin 46 is press fit into the upper wall of the tunnel, through its open center, and into the lower wall of the tunnel. The tunnel cam pin 46 is located strategically along the length of the tunnel 50 and passes through a slot in the tunnel pusher 38. The tunnel cam pin 46 locates the tunnel sub-assembly and the tunnel pusher sub-assembly relative to each other.

The tunnel pusher sub-assembly is comprised of the tunnel pusher 38, the left hooked link 58, the right hooked link 56, the link pivot pin 47 and the tunnel pusher stop 30, which is pinned via a press fit dowel 34 to the tunnel pusher 38. The left hooked link 58 and the right hooked link 56 are geometrically identical and positioned horizontally, opposing each other, pinned in the centered end slot of the tunnel pusher 38 by the link pivot pin 47. The pivot pin 47 is press fit into the tunnel pusher's upper wall above the slot 51, through the slot opening, the hooked links, and out the bottom of the tunnel pusher's lower wall. The hooked links pivot freely around the link pivot pin 47. The tunnel cam pin 46 is positioned behind the hooked links in such a way as to contact the rear surface of each hooked link when the sub-assembly is moved relative to the tunnel sub-assembly.

The final components, the reset springs 32, are captured between the rear surface of the tunnel stop 42 and the forward surface of the tunnel pusher stop 30. They push the tunnel sub-assembly and the tunnel pusher sub-assembly relative to each other allowing the Hooked Links to cam against the tunnel cam pin 46 and remain in a normally open position when the bow string holder is not affixed to the string loop 62. The tunnel can pin 46 holds the tunnel pusher sub-assembly from sliding out of the tunnel sub-assembly.

In an example embodiment, which is for illustration only and not meant to be limiting, each of the main components discussed above can be fabricated as follows:

Tunnel (50)—a stainless steel tube with a 0.38" OD/0.28" ID, approximately 1.45" long, having a 0.13" width vertical end slot from one end approximately 0.61" long through both the upper and lower walls. There are four press fit holes for 0.13" diameter dowels, each pair of holes being on the same center through both the upper and lower walls, in the same plane as the slot. One pair of holes secures the tunnel cam pin (46) and the other secures the tunnel stop (42). There are four 0.14" side slots that allow clearance for the left/right hooked links (56, 58). The inside leading and trailing slot radii edges are chamfered to eliminate binding on the links as they are actuated.

Tunnel Cam Pin (46)—a 0.13" OD Steel dowel pin, 0.38" long.

Tunnel Stop (42)—an aluminum 0.75" OD cylinder with a 0.38" ID hole through the center of its two parallel faces, perpendicular to the 0.75" OD. There is also a press fit hole for a 0.13" OD steel dowel pin drilled through the center of the 0.75" OD, perpendicular to the 0.38" ID hole.

Tunnel Pusher (38)—a steel 0.28" OD by 1.63" long, solid cylinder with a 0.13" width through slot 0.68" long from the end of the cylinder extending towards the opposite end. There is also a 0.13" width vertical through slot, perpendicular to the plane of the end slot that intersects the blind end of the 0.68" long end slot and extends 0.90" towards the opposite end. There is a 0.13" ID press fit hole for a 0.13" OD dowel through the center of the 0.28" OD cylinder on the opposite end of the cylinder longitudinally from the 0.68" long end slot. This is perpendicular to the 0.68" long end slot and there is a 0.09" ID press fit hole for a 0.09" dowel. This hole extends through the upper and lower walls of the 0.68" long end slot, perpendicular to its plane.

Left/Right Hooked Links (56, 58)—Steel links which are identical and oppose each other. They are 0.84" long by 0.25" wide by 0.06" thick. They are hooked on one end and angled on the other to be used as a cam surface. They each have a 0.09" ID slip fit hole drilled approximately in their center, by width, and longitudinally. The sharp edges are freely radiused to allow free actuation in the Tunnel (50).

Link Pivot Pin (47)—a steel dowel with a 0.09" OD, 0.28" long.

Tunnel Pusher Stop (30)—an aluminum 0.75" OD cylinder with a 0.28" ID hole through the center of its two parallel faces, perpendicular to the 0.75" OD. There is also a press fit hole for a 0.13" OD Steel dowel pin drilled through the center of the 0.75" OD, perpendicular to the 0.28" ID hole.

Reset Springs (32)—stainless steel compression springs having a 0.12" OD, rate of 0.58 #/in, SL 0.20, WD 0.010", load at SL 0.4 #. Such a spring is available from Lee Spring Company (www.leespring.com) as part no. CIM025D 07 S.

It should now be appreciated that the present invention provides a hands free compound archery bow holder in which the Lower Pulley/Cam of the hunter's compound bow is rested in a bow holster/sling, at crotch level. The bow is oriented vertically in a position with the bow string closest to the hunter (i.e., in the same orientation as when the bow is used/fired). A bow string holder is secured to the hunter at approximately chest height between the bow string and the hunter's chest. The bow string, e.g., via a string loop, is manually secured into the bow string holder.

In the illustrated embodiment, the string loop is positioned between the open hooked links of the bow string holder by inserting the string loop into the slot of the tunnel through the end of the tunnel closest to the string loop when the bow string holder is held in a horizontal position away from the hunter. Once the string loop is positioned in the tunnel slot and between the open hooked links, the hooked links are pivoted on the tunnel pusher around the string loop (from either side of the loop). Once fully pivoted, the hook of each link encompasses the string loop from either side inside the tunnel. The bow is then allowed to rock forward under its own weight in the holster/sling, away from the hunter, but still in a vertical shooting orientation.

The weight of the bow pulls the tunnel pusher sub-assembly forward, via the string loop, through the tunnel sub-assembly towards the bow and away from the hunter. The weight of the bow overrides the force of (but opposes the pull of) the reset springs, until the tunnel pusher stop contacts the tunnel stop. As the tunnel pusher sub-assembly is pulled forward by the weight of the bow, a strategically placed surface in the interior diameter ("ID") of the tunnel "cams" the hooked links to the fully closed position. With the hooked links in their fully closed position around the string loop, the hooked links are locked in the closed position by the tunnel's ID side walls on either side of the tunnel's end slot. The bow, with arrow nocked, remains stationary in this "ready" position until the hunter needs to release it from the bow string holder for use. With the bow secured in this ready position (i.e. the bow in vertical position, rocked forward, lower pulley/cam in the holster/sling, and secured to the hunter) the hunter awaits game to pass into the hunter's pre-established shooting lanes.

When ready to use the bow, the hunter's bow hand takes the bow and begins the aiming process. This process naturally raises the bow with the hunter's bow hand, with an arrow flocked, allowing the hunter to affix (if desired) a conventional mechanical release to the string loop. The hunter then begins to draw the bow string by the string loop. e.g. by using the mechanical release, and takes sight on the game. During the raising of the bow, the weight of the bow is taken off of the hooked links of the inventive bow string holder. This allows the reset springs to reverse the movement of the tunnel pusher sub-assembly. The tunnel cam pin now makes contact with the backside of the hooked links and cams them to the open position freeing the string loop, thus allowing the hunter to proceed with aiming and releasing of an arrow. Once the left and right hooked links are in their full open position, the bow string holder drops away from the bow and hangs at the hunter's chest during aiming and releasing of an arrow from the bow. The bow string holder can be used repeatedly as needed.

It is noted that the foregoing descriptions of specific embodiments of the invention are presented for purposes of illustration and description. They are not intended to be exhaustive or to limit the invention to the precise forms disclosed, and various modifications and adaptations are possible in view of the above teachings. Therefore, it is intended that the invention not be limited to the particular embodiments disclosed herein, but that the invention include all embodiments falling within the scope of the appended claims.

What is claimed is:

1. Apparatus for holding an archery bow in a ready, near shooting position, comprising:

a bow string holder having a releasable string hook;

a spring loaded actuator for said string hook, said actuator biasing said string hook into an open position and allowing said string hook to move from the open position to a closed position and vice-versa;

said string hook remaining in the closed position when tension is applied to said string hook counter to a spring force of the actuator by a bow string captured in said string hook; and said string hook automatically opening to release the bow string upon removal of said tension;

wherein:

said bow string holder comprises a tunnel intersected by a tunnel cam pin; and said string hook comprises a scissor mechanism adapted to slide within said tunnel such that the string hook will be in said open position when a scissor arm is actuated by said tunnel cam pin and in said closed position when said scissor arm is not actuated by said tunnel cam pin.

2. Apparatus in accordance with claim 1 comprising:

a user harness; and means for attaching said user harness to said bow string holder.

3. Apparatus in accordance with claim 2 comprising:

a sling for use in conjunction with the bow string holder and harness, said sling being adapted to attach to a user for holding a lower cam/pulley of a compound archery bow.

4. Apparatus for holding an archery bow in a ready, near shooting position, comprising:

a user harness adapted to be worn around a hunter's chest;

a sling adapted to attach to the hunter for holding a lower cam/pulley of a compound archery bow; and a bow string holder carried by said harness, said bow string holder adapted to attach to a string portion of said compound archery bow allowing said archery bow to hang from said bow string holder to maintain tension on said bow string holder;

wherein:

said bow string holder comprises:

a releasable string hook;

a spring loaded actuator for said string hook, said actuator biasing said string hook into an open position and allowing said string hook to move from the open position to a closed position and vice-versa;

a tunnel intersected by a tunnel cam pin;

said string hook remaining in the closed position when the tension is applied to said string hook counter to a spring force of the actuator by said string captured in said string hook;

said string hook automatically opens to release said string upon removal of said tension;

said string hook comprises a scissor mechanism adapted to slide within said tunnel such that the string hook will be in said open position when a scissor arm is actuated by said tunnel cam pin and in said closed position when said scissor arm is not actuated by said tunnel cam pin.

5. Apparatus in accordance with claim 4 wherein:

the tunnel extends from a tunnel stop, said tunnel having a pair of oppositely disposed slots along a length thereof;

a tunnel pusher extends from a tunnel pusher stop, said tunnel pusher being slidably received within said tunnel with said tunnel pusher stop spring loaded away from said tunnel stop;

the scissor mechanism is coupled to said tunnel pusher, said scissor mechanism having actuating levers at an end thereof closest to said tunnel pusher stop and forming said string hook at an opposite end thereof;

said scissor mechanism is adapted to slide within said tunnel together with said tunnel pusher such that the string hook will be in said open position when the actuating levers are registered with said slots and in said closed position when not registered with said slots;

said tunnel pusher stop is movable toward said tunnel stop against the force of the spring loading to slide the actuating levers out of registration with said slots and thereby close the string hook.

6. Apparatus in accordance with claim 5 wherein said tunnel comprises a channel at its distal end from said tunnel stop for allowing the string hook to capture and close around the string when the string is positioned within the channel.

7. Apparatus for holding an archery bow in a ready, near shooting position, comprising:

a bow string holder having a releasable string hook;

a spring loaded actuator for said string hook, said actuator biasing said string hook into an open position and allowing said string hook to move from the open position to a closed position and vice-versa;

said string hook remaining in the closed position when tension is applied to said string hook counter to a spring force of the actuator by a bow string captured in said string hook; and said string hook automatically opening to release the bow string upon removal of said tension;

wherein said bow string holder comprises:

a tunnel extending from a tunnel stop, said tunnel having a pair of oppositely disposed slots along a length thereof;

a tunnel pusher extending from a tunnel pusher stop, said tunnel pusher stop being spring loaded away from said tunnel stop;

a scissor mechanism coupled to said tunnel pusher, said scissor mechanism having actuating levers at an end thereof closest to said tunnel pusher stop and forming said string hook at an opposite end thereof;

said tunnel pusher and scissor mechanism being adapted to slide within said tunnel such that the string hook will be in said open position when the actuating levers are registered with said slots and in said closed position when not registered with said slots;

said tunnel pusher stop being movable toward said tunnel stop against the force of the spring loading to slide the actuating levers out of registration with said slots and thereby close the string hook.

8. Apparatus in accordance with claim 7 wherein said tunnel comprises a channel at its distal end from said tunnel stop for allowing the string hook to capture and close around the bow string when the bow string is positioned within the channel.

* * * * *